United States Patent [19]

Sargent et al.

[11] 4,109,345

[45] Aug. 29, 1978

[54] HINGED BRANCH HOLDER

[75] Inventors: Harry Sargent, Austin, Tex.; Si Spiegel, Briarcliff Manor, N.Y.

[73] Assignee: American Technical Institute, Inc., Mount Vernon, N.Y.

[21] Appl. No.: 771,739

[22] Filed: Feb. 24, 1977

[51] Int. Cl.[2] ..... E05D 1/06; E05D 7/12; A47G 33/06

[52] U.S. Cl. ..... 16/149; 16/171; 248/512; 428/18

[58] Field of Search ..... 16/149, 171, 137, 181; 248/27.8, 512, 513; 211/196, 96; 428/18, 19, 20

[56] References Cited

U.S. PATENT DOCUMENTS

| | | | |
|---|---|---|---|
| 2,550,023 | 4/1951 | Reilly | 248/513 |
| 3,085,774 | 4/1963 | Di Ienno | 248/512 |
| 3,159,523 | 12/1964 | Abramson | 16/137 |
| 3,164,344 | 1/1965 | Whyte | 248/512 |
| 3,616,102 | 10/1971 | Baus et al. | 428/18 X |
| 3,728,202 | 4/1973 | Baus et al. | 428/18 X |
| 3,928,689 | 12/1975 | Mottel | 428/20 |
| 3,978,550 | 9/1976 | Brown | 16/171 |

FOREIGN PATENT DOCUMENTS

| | | | |
|---|---|---|---|
| 698,110 | 11/1964 | Canada | 428/20 |
| 712,611 | 9/1966 | Italy | 428/18 |

*Primary Examiner*—James Kee Chi

[57] ABSTRACT

A hinge assembly for artificial Christmas trees that allows for the collapse of the tree without danger of the hinge binding or pinching materials in contact with the hinge and which is well suited to fabrication by mass production techniques.

4 Claims, 8 Drawing Figures

HINGED BRANCH HOLDER

BACKGROUND OF THE INVENTION

This invention relates to artificial trees and more specifically, relates to an improved hinge assembly for connecting branches to the trunk of the tree, such as a Christmas tree.

Artificial trees of collapsible structure, particularly Christmas trees, have been sold commercially for some time. Such trees utilize a trunk and a number of branches attached to the trunk which can be swung between extended or open positions for use and collapsed or closed positions for storage, thereby minimizing the storage space required and the need for constant reassembly. Such trees have met with limited consumer acceptance because of the expense, complexities of assembly and lack of durability and reliability. One of the primary stumbling blocks in this area has been designing a simple, durable hinge assembly for mounting individual branches on the tree trunk.

Earlier hinge designs were defective in that they offered no protection from pinching or crimping materials between the tree trunk and the hinge assembly. For example repeated crimping of electrical cords utilized in conjunction with decorative lighting could result in damage to the cords and would be a fire hazard and electrical shock hazard. The hinge design of the present invention has overcome this problem. In addition, the design of the invention is very simple and well suited to mass production. The invention will make it possible to produce a safe, reliable tree at a reasonable price and thereby increase consumer acceptance.

SUMMARY OF THE INVENTION

A hinge assembly connects the limbs to the trunk of an artificial tree. The hinge assembly consists of a hollow cylindrical collar having a central axis, a means to attach the collar to the trunk and a plurality of radial brackets having one end attached to the collar. These brackets have parallel opposed sides and an aperture extending through the parallel opposed sides. The axis of the bracket's apertures are substantially orthogonal to the axis of the collar. A plurality of arms connect the limbs to the brackets. The arms have a first portion forming a U-shaped channel of sufficient width to engage the bracket. This first portion of the arm has coaxial apertures so located that when aligned with the bracket apertures, the arm will be properly aligned with the bracket. The end surface of the first portion is a smooth curve, the major portion of which is convex but which does terminate with a concave segment to accomodate the bracket when the arm is in a downward position. The second portion of the arm is adapted to hold a branch and is narrower than the first portion. Finally, there is a pivot means passing through the bracket aperture and an aperture in the arm to attach the arm to the bracket. The arm is free to pivot from its outstretched position in an upward direction with its mobility being limited by the arm abutment with the bracket.

DESCRIPTION OF THE PREFERRED EMBODIMENTS

The invention relates to the design of a collapsible artificial Christmas tree and, more particularly, to the hinge assembly which permits the collapse of the limbs for storage and yet provides support to the limbs when the tree limbs are extended.

Figure 1:
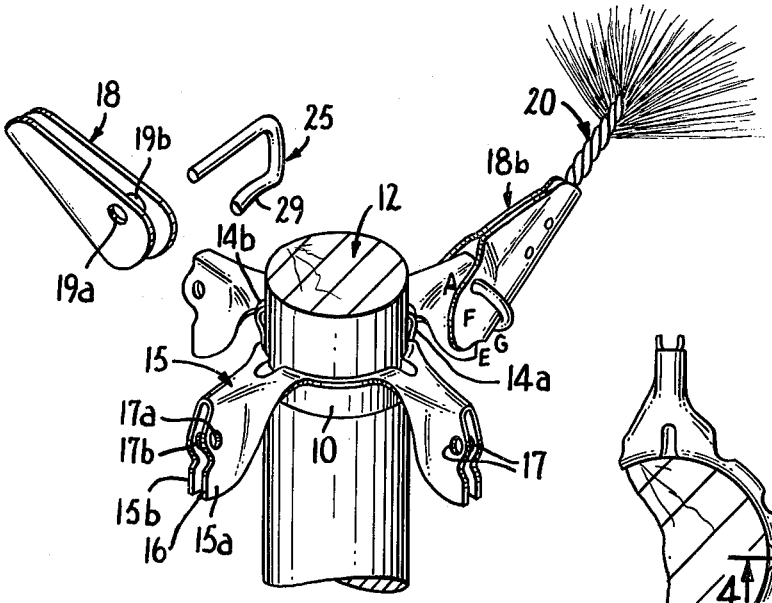
FIG. 1 is a perspective view of one embodiment of the invention showing a segment of the trunk portion of an artificial tree, including the inventive hinge assembly.
Figure 2:
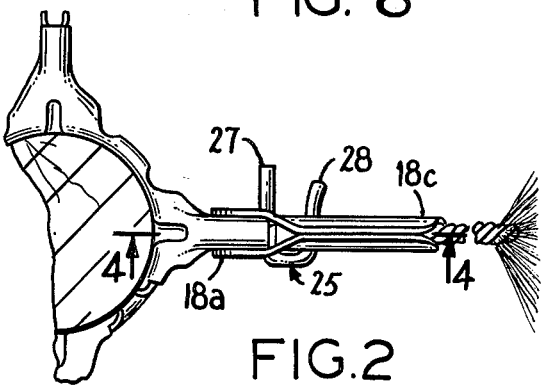
FIG. 2 is a top view of the inventive hinge assembly illustrated in FIG. 1.
Figure 3:
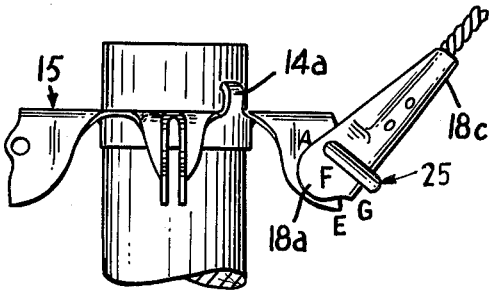
FIG. 3 is a side view of the hinge assembly illustrated in FIG. 1.

In describing the details of the invention it will be helpful to refer to the accompanying drawing. One of the embodiments of the invention is illustrated in FIGS. 1 through 4. FIG. 1 shows a perspective view of the hollow cylindrical collar 10 that is connected to a trunk 12. The trunk may be fashioned of wood or some other appropriate material. The collar is preferably made of metal. The collar has two metal tabs **14*a* and 14*b* attached to it which serve as connecting means. The tabs 14*a* and 14*b* include a pointed end, which, when embedded in the trunk (as shown in FIG. 3), serve to prevent relative motion between the trunk and collar. Also attached to the collar are a series of radially extending brackets 15 having parallel opposed sides 15*a* and 15*b*, the sides 15*a* and 15*b* being substantially parallel to the axis of the collar 10. The brackets 15 may consist of U-shaped channels. Each of the brackets has an aperture 17, which extends through the bracket and which is positioned to maximize the distance between the aperture and the trunk. If a U-shaped bracket is used, coaxial apertures 17*a* and 17*b*** are provided in each of the opposed sides. The collar, connecting means, and brackets of the illustrated embodiment may be made from low carbon steel. Furthermore, they may be manufactured as an integral unit by stamping, thereby reducing the production time and costs.

Figure 4:
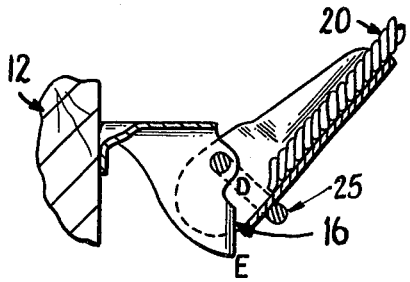
FIG. 4 is a cross section of a hinge assembly as viewed along 4—4 of FIG. 2.
Figure 6:
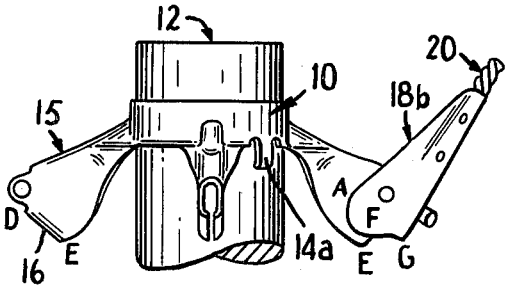
FIG. 6 is a side view of a second embodiment of the hinge assembly.

Arms 18 are elongated U-shaped members having a first end **18*a* which is configured to fit over the outer end 16 of bracket 15, this outer end of the bracket having a straight segment DE as shown in FIGS. 4 and 6 which, in the first embodiment, is substantially parallel to the collar axis. The arms 18 may be fabricated from sheet metal or similar materials. A pair of co-axial apertures 19*a* and 19*b* are provided respectively in each of the opposed sides of the arms and are located adjacent to a first end 18*a*** of the arm. These apertures are so located that when a bracket and arm are assembled, the axis of the bracket aperture and the axis of the arm apertures are co-linear.

The first end **18*a* of arm 18 terminates in a curved end surface AG. The major portion of this surface is convex with a small segment of the surface being concave in the vicinity G in order to accomodate the portion of end 16 of the bracket 15 designated ED in FIG. 4** when the arm is in its fully extended position position.

At all intermediate positions of the arm the curved surface AG of the arm and the straight surface ED of the bracket intersect at a variable point F. The resulting angle EFG has one straight leg FE and one curved leg FG. When the arm is raised to a position where the angle EFG is sufficiently large to accomodate foreign objects, the straight surface ED of the bracket intersects the convex portion of AG of the arm end 18*b* at point F, and the resulting angle EFG has one straight leg EF and one curved leg FG. In the vicinity of the point of intersection of AG and ED (point F), the curvature of the leg FG is such that as one constructs tangents to the curve moving toward G along FG the angle formed between the tangent and the side EF is increasing in magnitude as one moves away from F. This creates a divergent angle that will promote the rejection of foreign objects from the hinge.

Figure 8:
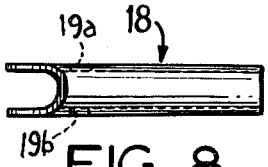
FIG. 8 is a view of the arm of the hinge assembly before it is coupled to a branch.

The second portion of the arm 18*c* is designed to accomodate an artificial limb 20, typical limbs consisting of plastic needles interspersed between twisted wires to form a limb. The arm before the installation of the limb forms a continuous U-shaped channel such as arm 18 (also see FIG. 8). The limb is placed in the outer portion of the channel 18*c* which is not required to interface with the bracket when the arm pivots. This outer portion of the channel is collapsed about the wire limb to hold it firmly in place. Employing this means of securing limbs adds to the flexibility of the design by allowing one to employ various size limbs to be attached to the arm, since the arm can be crimped about limbs of varying cross section; an arm with connected limb 18*b* is then ready for installation to a bracket.

The arm is removably connected to the bracket by a pivot pin 25 which may be a U-shaped rod fabricated from a material such as a low alloy steel. A first substantially straight leg 27 of this U-shaped pivotal means passes through the aligned apertures 17 of the bracket and apertures 19*a* and 19*b* of the arm. The leg 27 of the pin 25 serves as the pivot element for the hinge while the second leg 28 of pin 25 passes over the lower exterior surface of the arm 18 and presses against this surface to secure the rod to the arm. To provide this locking feature the leg 28 of the pin 25 is inwardly bent at a point 29 as shown in FIG. 1. This inwardly bent portion is forced over and then locks the pin 25 around the arm 18 as shown in FIG. 2. Thus this U-shaped rod serves two purposes. It acts as the fulcrum of the hinge and it also serves as a removable connecting means between the bracket 15 and the arm 18. The pin 25 is easily installed by forcing the inwardly bent portion over arm 18 and may be removed by forcing leg 28 outwardly away from leg 27 to permit leg 28 to move across arm 18.

Figure 5:
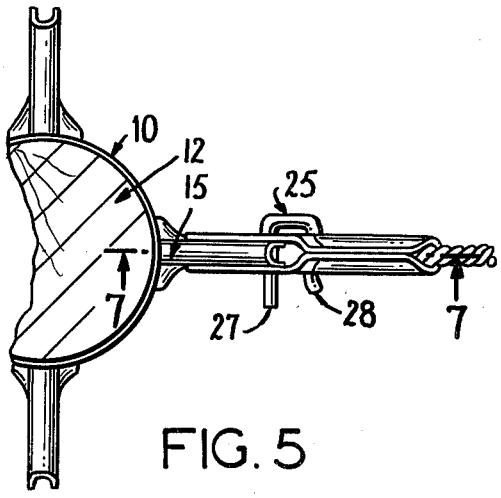
FIG. 5 is a top view of a second embodiment of the hinge assembly.
Figure 7:
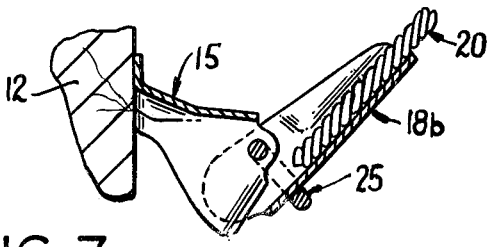
FIG. 7 is a cross section of the second embodiment of the hinge assembly as viewed along 7—7 of FIG. 5.

A second embodiment is illustrated in FIG. 5 through 7. Again, the hinge assembly consists of a hollow cylindrical collar 10, metal tabs (14*a* shown) that fasten the collar to the trunk 12, and radial brackets 15. Each of the brackets has an aperture 17 which is positioned to maximize the distance between the aperture and the trunk. The arms 18 and the limb 20 in this embodiment are as described in the first embodiment. Again, the arm 18 fits over the outer end of the bracket 16. In this embodiment, the straight segment DE of the outer end of the bracket 15 is not parallel to the axis of the collar but sloped so that a continuation of the line from D to E would intersect the axis of the collar. This will increase the angle EFG over that which results from the first embodiment and further promote the ejection of foreign material from the hinge when the arm is being extended.

The arm is removably connected to the bracket by a pivot pin 25 which is of the same design as in the first embodiment.

The above discussed embodiments offer to the manufacturer hinge assemblies having a very simple design which lend themselves to rapid production techniques that can substantially reduce the cost of production while maintaining the quality of the product. This cost-saving will be reflected in the market price.

Trees employing this invention will be safer and meet with less consumer resistance, thereby opening up new markets for the artificial Christmas tree.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

What is claimed is:

1. A hinge assembly for the connection of limbs to the trunk of an artificial tree comprising a hollow cylindrical retaining collar having a central axis, connecting means to attached said collar to said trunk, a plurality of radial brackets having a first end attached to said collar and a second end surface, said bracket having parallel opposed sides attached to and extend outwardly from said collar and having a bracket aperture extending through said parallel opposed sides, with the axis of said bracket aperture being substantially orthogonal to the axis of said collar, a plurality of arms for connecting said limbs to said brackets, each of said arms having a first portion forming a U-shaped channel of sufficient width to engage said second end of said brackets, said first portion having co-axial apertures so located that when aligned with the bracket apertures will insure alignment between said arm and said bracket, said first portion further having a curved end surface, the major portion of which is convex but terminating in a concave segment said concave segment and said second end surface cooperating to form a divergent angle therebetween as said arm is moved in a downward direction, a second portion adapted to hold said branch,

2. A hinge assembly for the connection of limbs to the trunk of an artificial tree as described in claim 1, wherein said brackets are U-shaped channels having both flat sides of said channel parallel to axis of said collar.

3. A hinge assembly as described in claim 1, wherein said pivoted means is a removable U-shaped rod with one substantially straight leg of said rod passing through said apertures of said arm and bracket and serving as the pivotal element for the hinge assembly, with a second leg passing over the exterior surface of said arm and having an inwardly bent portion between the said arm and the free end of said second leg, whereby the pressure of said second leg or said arm secures said U-shaped rod.

4. A hinge assembly as described in claim 1, wherein said connecting means is a metal tab forming an integral portion of said collar.

* * * * *

UNITED STATES PATENT OFFICE

CERTIFICATE OF CORRECTION

Patent No. 4,109,345 Dated August 29, 1978

Inventor(s) Harry Sargent and Si Spiegel

It is certified that error appears in the above-identified patent and that said Letters Patent are hereby corrected as shown below:

The name of the assignee is incorrect:

"American Technical Institute, Inc."
--American Technical Industries, Inc.--

Claim 1, column 4, line 27, "attached" should be --attach--.

Claim 1, column 4, line 31, "extend" should be --extending--.

In claim 1, the last four lines of the original text were mistakenly omitted. After line 50, add the following paragraph:

--a pivot means for attaching said brackets to said arms so that said arm is free to pivot in an upward direction, the upward mobility of said arm being limited by abutment of said channel with said bracket.--

Signed and Sealed this

First Day of May 1979

[SEAL]

Attest:

RUTH C. MASON
Attesting Officer

DONALD W. BANNER
Commissioner of Patents and Trademarks